United States Patent [19]

Ebersole

[11] Patent Number: 5,007,118

[45] Date of Patent: Apr. 16, 1991

[54] HEAD CARE STATION AND KIT AND METHOD FOR RECLINING THE OCCUPANT OF A WHEELCHAIR AGAINST A HEAD SUPPORT

[76] Inventor: Larry W. Ebersole, 7826 Newlin Dr., Fort Wayne, Ind.

[21] Appl. No.: 330,705

[22] Filed: Mar. 30, 1989

[51] Int. Cl.[5] ..... A45D 19/00; A45D 19/08; A45D 44/10

[52] U.S. Cl. ..... 4/515; 4/516; 4/519; 4/523; 248/139; 297/310; 297/DIG. 4; 414/678

[58] Field of Search ..... 4/515, 516, 519, 523; 297/310, DIG. 4; 414/678; 280/250.1; 248/139, 143

[56] References Cited

U.S. PATENT DOCUMENTS

| | | | |
|---|---|---|---|
| 2,315,153 | 3/1943 | Ellinger | 4/517 |
| 2,507,630 | 5/1950 | Green | 4/517 |
| 3,190,502 | 6/1965 | Knibb | 4/517 X |
| 4,192,549 | 3/1980 | Petersen | 297/DIG. 4 X |
| 4,527,944 | 7/1985 | Quolly et al. | 414/678 |
| 4,561,823 | 12/1985 | Norton | 414/678 |
| 4,725,188 | 2/1988 | Zimmerman et al. | 414/678 |
| 4,726,730 | 2/1988 | McConnell | 414/678 |
| 4,830,567 | 5/1989 | Rachman | 414/678 |
| 4,834,411 | 5/1989 | Willey et al. | 280/250.1 |

*Primary Examiner*—Henry K. Artis
*Attorney, Agent, or Firm*—Lundy and Walker

[57] ABSTRACT

A head care station for use with a wheelchair and a kit therefore and a method for reclining the occupant of a wheelchair against a head support. The head care station has a foundation member having a front portion and a back portion. A wheelchair jack is mounted to the front portion. The wheelchair jack has a bearing member movable between a floor position and an elevated position. A head support is connected to the back portion of the foundation member. The head support is movable between a lower position and an upper position. A bolster is connected to the back portion of the foundation member. The bolster is disposed at a vertical elevation above the elevated position of the wheelchair jack. The wheelchair jack and the bolster define between them an occupancy space.

29 Claims, 5 Drawing Sheets

HEAD CARE STATION AND KIT AND METHOD FOR RECLINING THE OCCUPANT OF A WHEELCHAIR AGAINST A HEAD SUPPORT

BACKGROUND OF THE INVENTION

This invention relates to assist devices for occupants of wheelchairs and to methods of repositioning occupants of wheelchairs, and more particularly to a head care station for use by an occupant of a wheelchair, a kit therefore, and a method for reclining the occupant of a wheel chair against a head support.

It is difficult to provide head care, such as shampoos, to persons confined to wheelchairs and other personal transport devices. Beauty or barber chairs are available, which will recline a seated person against a horizontal or nearly horizontal head support. To perform head care for a person confined to a wheelchair or other personal transport device, the person must first be transferred into the reclining chair. This is time consuming and difficult and in some circumstances presents an insurmountable burden; for example, where the occupant of the wheelchair is too heavy for the care provider to lift. The reclining chair may also present, in effect, a barrier to access for otherwise independent persons confined to wheelchairs.

It is therefore highly desirable to provide an improved head care station and an improved kit therefore and an improved method for reclining the occupant of a wheelchair against a head support.

It is also highly desirable to provide an improved head care station and an improved kit therefore and an improved method for reclining an occupant of a wheelchair against a head support from which head care may be provided to the occupant of a wheelchair or other personal transport device while the occupant remains in that wheelchair or device.

It is also highly desirable to provide an improved head care station and an improved kit therefore and an improved method for reclining the occupant of a wheelchair against a head support, in which a wheelchair and occupant may be first placed in a reclined position, and then a head support raised against the occupant.

It is also highly desirable to provide an improved head care station and an improved kit therefore and an improved method for reclining the occupant of a wheelchair against a head support, in which the head care station is useful for wheelchairs, gurneys and other personal transport devices, without modification.

It is also highly desirable to provide an improved head care station and an improved kit therefore and an improved method for reclining the occupant of a wheelchair against a head support which may be used by a single operator either with no assistance or with unskilled assistance.

It is finally highly desirable to provide an improved head care station and an improved kit therefore and an improved method for reclining the occupant of a wheelchair against a head support which combines all of the above desired features.

SUMMARY OF THE INVENTION

It is an object of this invention to provide an improved head care station and an improved kit therefore and an improved method for reclining the occupant of a wheelchair against a head support.

It is also an object of this invention to provide an improved head care station and an improved kit therefore and an improved method for reclining an occupant of a wheelchair against a head support from which head care may be provided to the occupant of a wheelchair or other personal transport device while the occupant remains in that wheelchair or device.

It is also an object of this invention to provide an improved head care station and an improved kit therefore and an improved method for reclining the occupant of a wheelchair against a head support, in which a wheelchair and occupant may be first placed in a reclined position, and then a head support raised against the occupant.

It is also an object of this invention to provide an improved head care station and an improved kit therefore and an improved method for reclining the occupant of a wheelchair against a head support, in which the head care station is useful for wheelchairs, gurneys and other personal transport devices, without modification.

It is also an object of this invention to provide an improved head care station and an improved kit therefore and an improved method for reclining the occupant of a wheelchair against a head support, which may be used by a single operator either with no assistance or with unskilled assistance.

It is finally an object of this invention to provide an improved head care station and an improved kit therefore and an improved method for reclining the occupant of a wheelchair against a head support which combines all of the above desired features.

In the broader aspects of this invention, there is provided a head care station for use with a floor accessible to a wheelchair and a kit therefore and a method for reclining the occupant of a wheelchair against a head support. The head care station has a foundation member having a front portion and a back portion. A wheelchair jack is mounted to the front portion. The wheelchair jack has a bearing member movable between a floor position and an elevated position. A head support is connected to the back portion of the foundation member. The head support is movable between a lower position and an upper position. A bolster is connected to the back portion of the foundation member. The bolster is disposed at a vertical elevation above the elevated position of the wheelchair jack. The wheelchair jack and the bolster define between them an occupancy space extending up from the floor.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
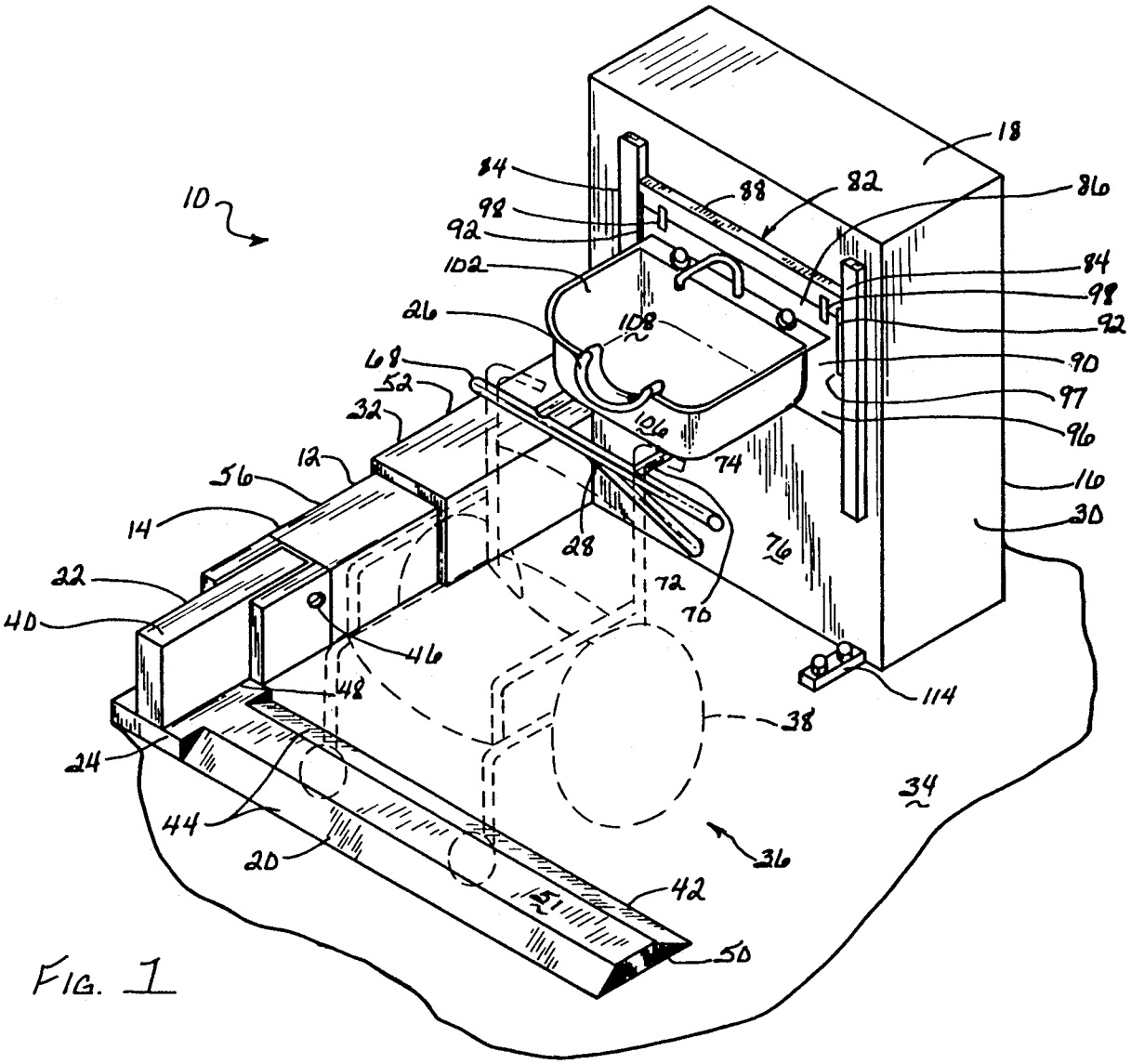
FIG. 1 is a perspective view of the head care station of the invention as used with an unoccupied wheelchair shown in dashed lines.

The head care station 10 of the invention, has a foundation member 12 which has a front portion 14 and a back portion 16.

A wheelchair jack 20 is mounted to front portion 14. Wheelchair jack 20 has a main portion 22 and a bearing member 24.

A head support 26 and a bolster 28 are connected to pedestal 18. Pedestal 18 is movable along foundation member 12. Foundation member 12 extends longitudinally of head care station 10. Head support 26 and bolster 28 and bearing member 24 are each offset from foundation member 12 laterally, as illustrated in the Figures. Foundation member 12 may also perform additional functions, unrelated to the invention, for example, foundation member 12 may be a part of a building structure. The offset of foundation member 12 permits access by a wheelchair 38 or other personal transport device (not illustrated) by an operator or other person (not illustrated) assisting a wheelchair occupant into the general area of head support 26. Wheelchair 38 is supported by the same supporting surface which supports foundation member 12, which in the embodiment illustrated is the floor upon which head care station 10 rests.

Wheelchair 38, shown in FIG. 1, is a conventional manual wheelchair. The invention is not limited to manual wheelchairs, but rather is useful with wheelchairs of all types, including "wheelchairs" in which wheels are replaced by tracks or the like, and gurneys and other personal transport devices.

Bearing member 24 of wheelchair jack 20 has an upright longitudinal member 40 and a transverse member 42. Transverse member 42 has an upstanding substantially planar support surface 51. Edges 44 of transverse member 42 may be sloped toward floor 34, in order to decrease the effort required to roll wheelchair 38 onto surface 51 or over transverse member 42. It is desirable that transverse member 42 extend in a direction transverse to foundation member 12 well in excess of the width any wheelchair 38 or other personal transport device which head care station 10 of the invention might be called on to accommodate. This deters lateral slippage of the wheelchair 38 off bearing member 24. In a particular embodiment of the invention, transverse member 42 may have a length in a direction transverse to foundation member 12 from an inner end 48 adjacent longitudinal member 40 to an outer end 50 greater than the length of bolster 28 in the same direction.

Figure 2:
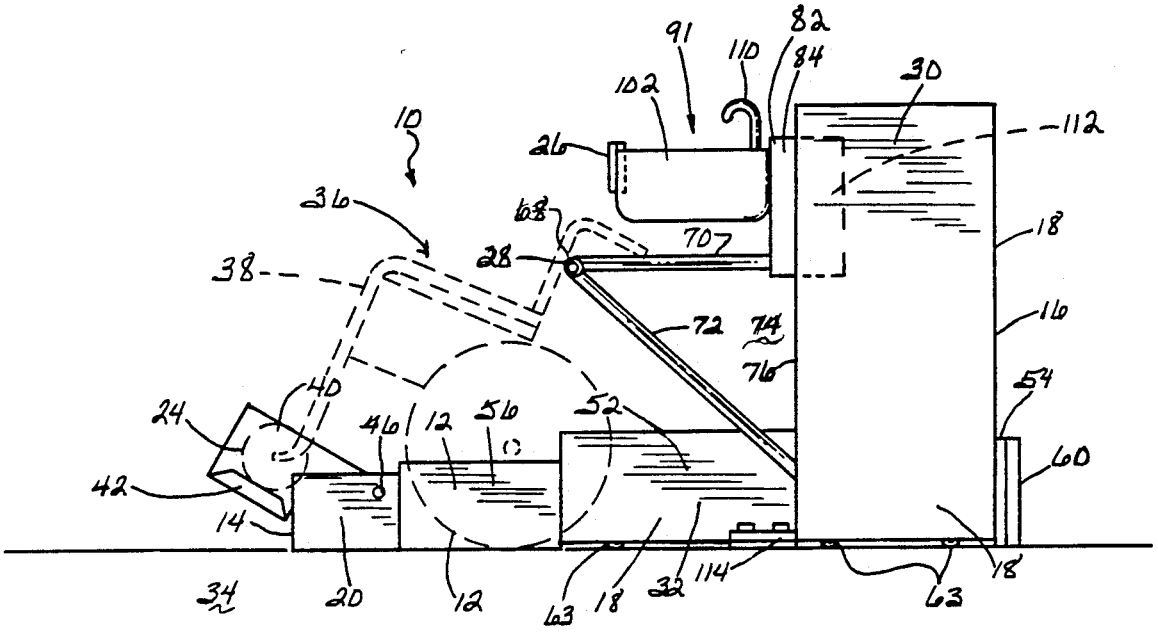
FIG. 2 is a side plan view of an embodiment of the head care station shown in FIG. 1 showing the wheelchair and the bearing member in an elevated position.
Figure 5:
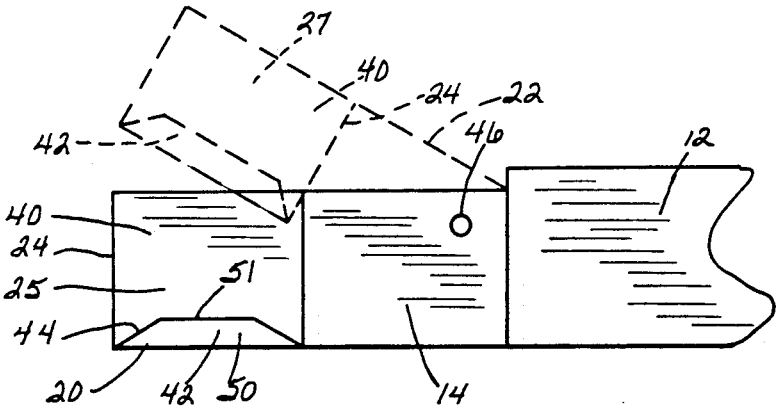
FIG. 5 is an enlarged partial side plan view of the front of the head care station of the invention showing the bearing member in an elevated position in dashed lines and in a lowered position in solid lines.

Bearing member 24 is movable between a floor position 25, illustrated by solid lines in FIG. 5, and an elevated position 27, illustrated by solid lines in FIG. 2 and by dashed lines in FIG. 5, and is retained in positions 25, 27 against the weight of an occupied wheelchair 38. In particular embodiments of the invention, transverse member 42 rests upon floor or surface 34 in floor position 25, and desirably bearing member 24 is movable to and may be retained in any position between positions 25 and 27.

Bearing member 24 in moving between floor position 25 and elevated position 27 pivots on pivot axis 46. Pivoting is desirable for the reason that in pivoting, transverse member 42 serves, not only to lift the front end of wheelchair 38 but also to choke the front wheels, preventing them from rolling. In other alternative embodiments of the head care station 10 of the invention, bearing member 24 could take other forms such as a pair of channels sized to hold and retain the front wheels of wheelchair 38 or arms adapted to grip the front wheels of wheelchair 38.

Figure 3:
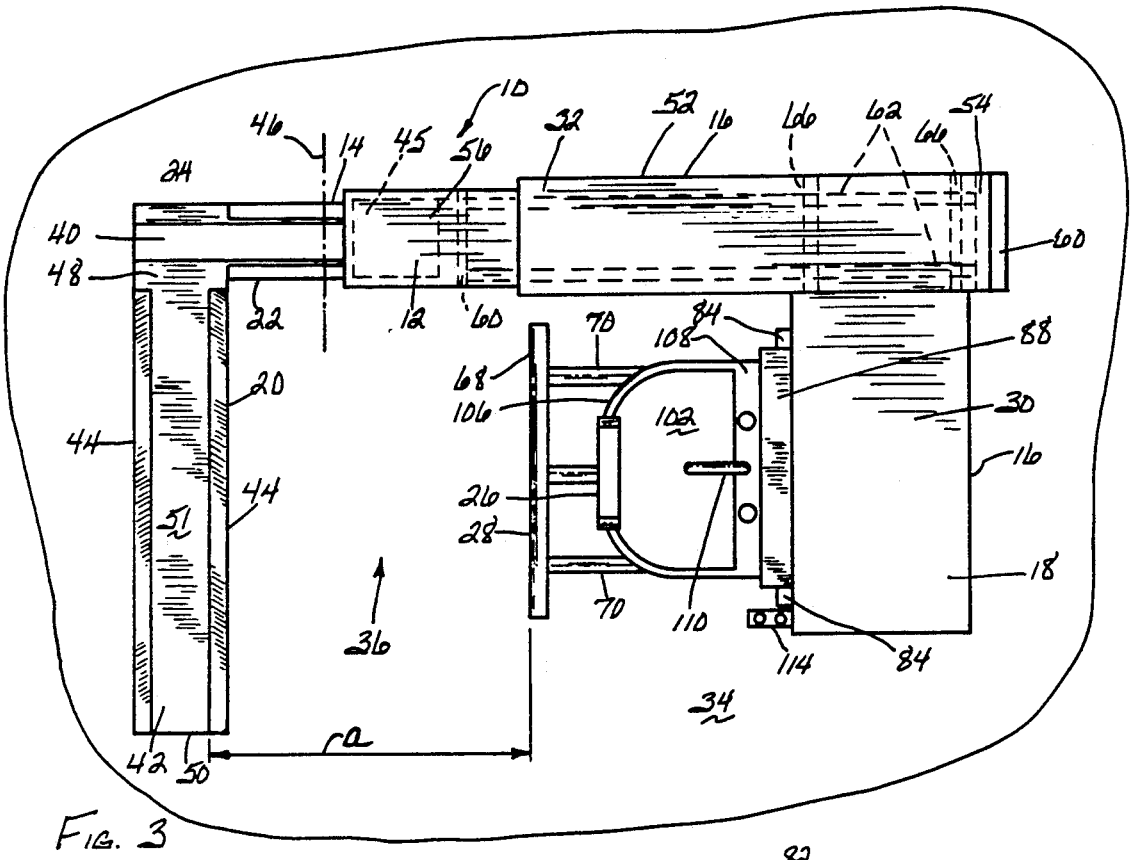
FIG. 3 is a top plan view of an embodiment of the head care station shown in FIGS. 1 and 2, illustrating the pedestal in a fully rearward position.
Figure 6:
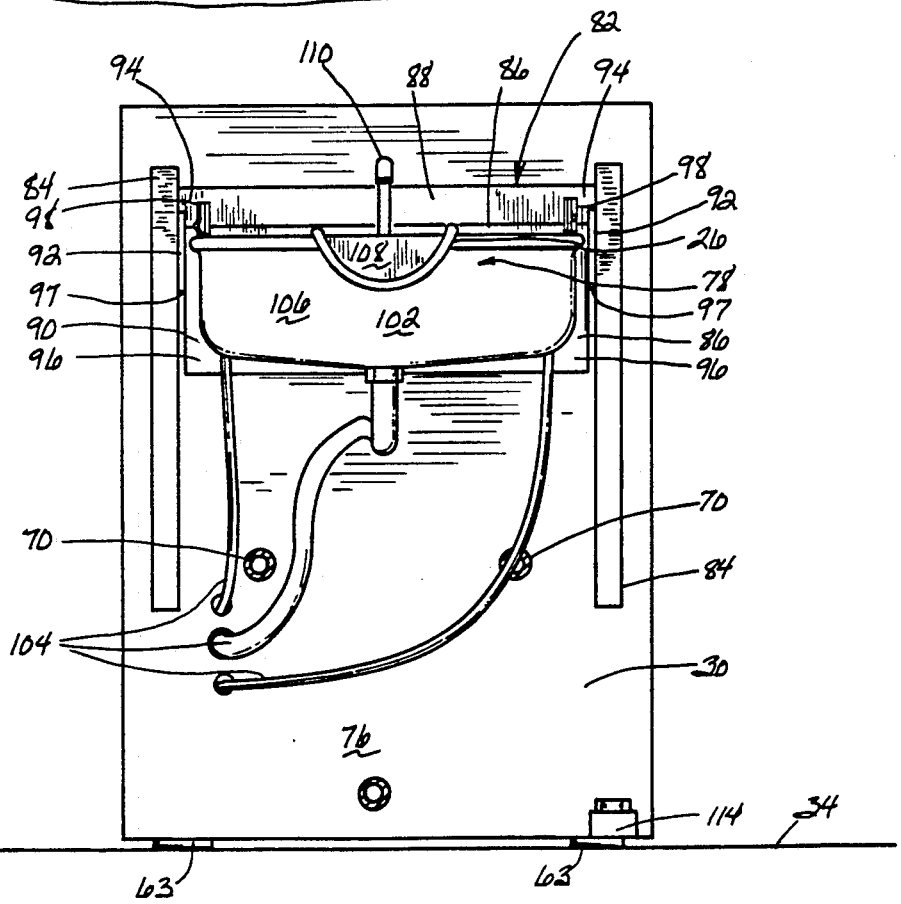
FIG. 6 is a partial front plan view of the head care station of the invention, as shown in FIGS. 1 and 2, illustrating the upright member of the head care station of the invention. The bolster and lower brace are deleted for clarity. The displacer is shown in an upper position.
Figure 4:
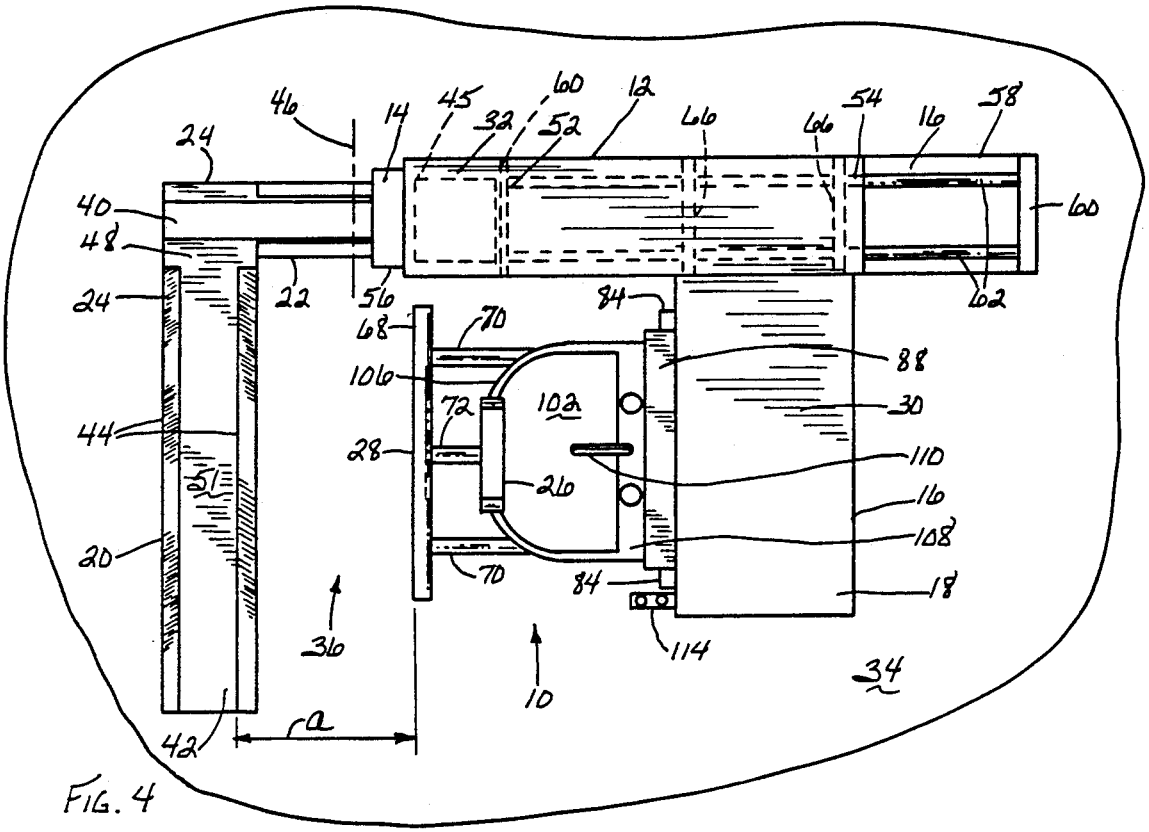
FIG. 4 is a top plan view of the head care station of FIG. 3 illustrating the pedestal in a fully forward position.
Figure 7:
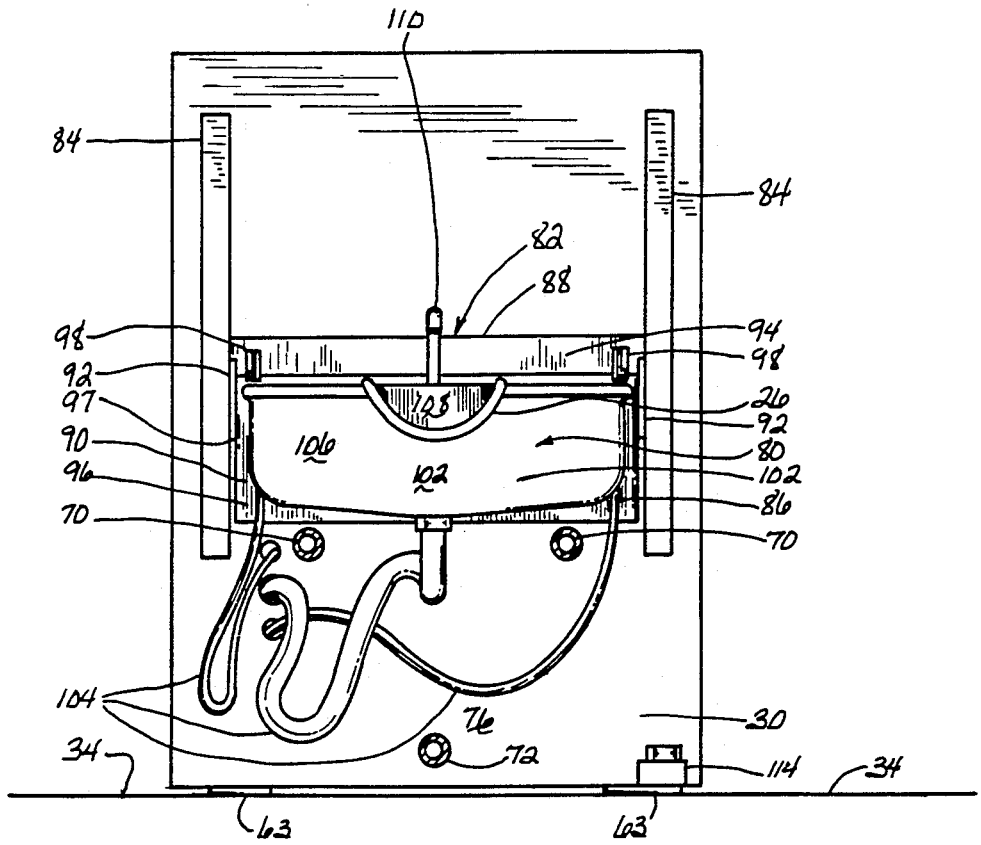
FIG. 7 is the same view as FIG. 6, showing the displacer in a lower position.

Wheelchair jack 20 has a jacking mechanism 45 shown only in dashed lines in FIGS. 3 and 4 located within main portion 22 which may be powered manually, electrically, hydraulically, pneumatically, or by some other means. The jacking mechanism is capable of raising and retaining bearing member 24 and the front end of an occupied wheelchair 38 in a raised position. In a particular embodiment of the invention, wheelchair jack 20 includes limiters (not shown) which keep the pivoting of bearing member 24 between floor position 25 in which wheelchair jack 20 is supported by floor 34 and a preselected limit corresponding to elevated position 27.

In particular embodiments of the invention, pedestal 18 has "L" shaped horizontal cross-sections at heights below the upper surface of longitudinal member 32. Foundation member 12 and longitudinal member 32 of pedestal 18 are each below the elevation of bolster 28 in order to increase the stability of health care station 10. In a particular embodiment of the invention, head care station 10 is free standing, supported by floor 34, and is not affixed to floor 34 or to any other part of adjacent structure except for flexible water, sanitary drain and power connections.

Defined between wheelchair jack 20 and bolster 28 and foundation member 12 and extending up from floor 34 is a occupancy space 36. The length "a" of occupancy space 36 between support surface 51 of bearing member 24 and bolster 28 determines the length of a wheelchair 38 which may be accommodated within head care station 10. The term "length" of a wheelchair 38 refers herein to the horizontal dimension of a wheelchair 38 between its front axle or other forward support point and the back of the wheelchair 38 at the height of bolster 28. In a particular embodiment of the head care station 10 of the invention, length "a" of occupancy space 36 is not variable and thus a wheelchair 38 of only a particular length "b" may be accommodated. Gurneys and other substantially horizontally disposed personal transport devices (not illustrated), which would not need to be tipped to place an occupant's head in a roughly horizontal position, can be accommodated. In another particular embodiment of the head care station 10 of the invention, the length "a" of occupancy space 36 is adjustable by relative movement of bearing member 24 and pedestal 18 along foundation member 12 toward and away from each other whereby wheelchairs 38 of a wide variety of lengths and gurneys and other personal transport devices can be accommodated.

Movement of pedestal 18 relative to foundation member 12 may be provided by a variety of means. In the embodiment of the invention illustrated in the Figures, longitudinal member 32 of pedestal 18 has a front section 52 which is channel shaped and rides upon a carrier section 56 of foundation member 12. Rear section 54 of longitudinal member 32 has a track section 58 comprised of a pair of spaced pedestal guides 66. A pair of opposed spaced apart stops 60 are secured to foundation member 12. A pair of rods 62 extend between stops 60 and through holes in pedestal guides 66. Upright member 30 of pedestal 18 may be cantilevered from longitudinal member 32 or alternatively supported by rollers 63 as shown which underlie upright member 30. In the embodiment illustrated, pedestal 18 is movable between stops 60 along foundation member 12 which is stationary.

In one embodiment, pedestal 18 locks in position frictionally against the rods 62 by the force applied to bolster 28 by a tilted occupied wheelchair 38. In another particular embodiment of the invention, bolster 28 includes an interlock (not shown) which prevents movement of pedestal 18 when bearing member 24 of wheelchair jack 20 is raised.

Bolster 28 is located vertically above elevated position 27 of bearing member 24 and above the center of gravity of an occupied wheelchair 38 to preclude overturning of wheelchair 38. Bolster 28 is located horizontally between wheelchair jack 20 and head support 26.

In a particular embodiment of the invention, bolster 28 is a part of a bolster assembly 68 which includes bolster 28, side braces 70 and lower brace 72 and is mounted to the face 76 of upright member 30. Lower brace 72 is angled from bolster 28 to the face 76 of upright member 30 so as to not present an obstruction, for example, to a wheelchair 38 having a large rearward mounted battery pack or to janitorial personnel. To the rear of bolster 28 and between side braces 70 is defined a protected space 74 within which wheelchair 38 or other personal transport device cannot intrude. Plumbing 104 may be disposed within and above protected space 74 to prevent damage due to a misdirected wheelchair 38 or other personal transport device.

Bolster 28 receives wheelchair 38 when tilted by wheelchair jack 20. It is desirable that bolster 28 extend the opposite sides of wheelchair 38 both so as to better distribute weight and to prevent slippage of a misaligned wheelchair 38. In a particular embodiment of the invention, bolster 28 is a padded rod or tube disposed horizontally and transversely of foundation member 12.

Bolster 28 must be immovably related to wheelchair jack 20 when an occupied wheelchair 38 is tilted up by wheelchair jack 20. In an alternate embodiment of the invention, bolster 28 could retract for storage and be extended either prior to or during the tilting of occupied wheelchair 38. This embodiment of the invention is, however, not preferred since it presents an added risk that bolster 28 will not be in its proper position to receive the occupied wheelchair 38 by reason of either human mistake or equipment failure. In a preferred embodiment of the invention, bolster 28 is mounted in fixed relationship to pedestal 18.

Figure 8:
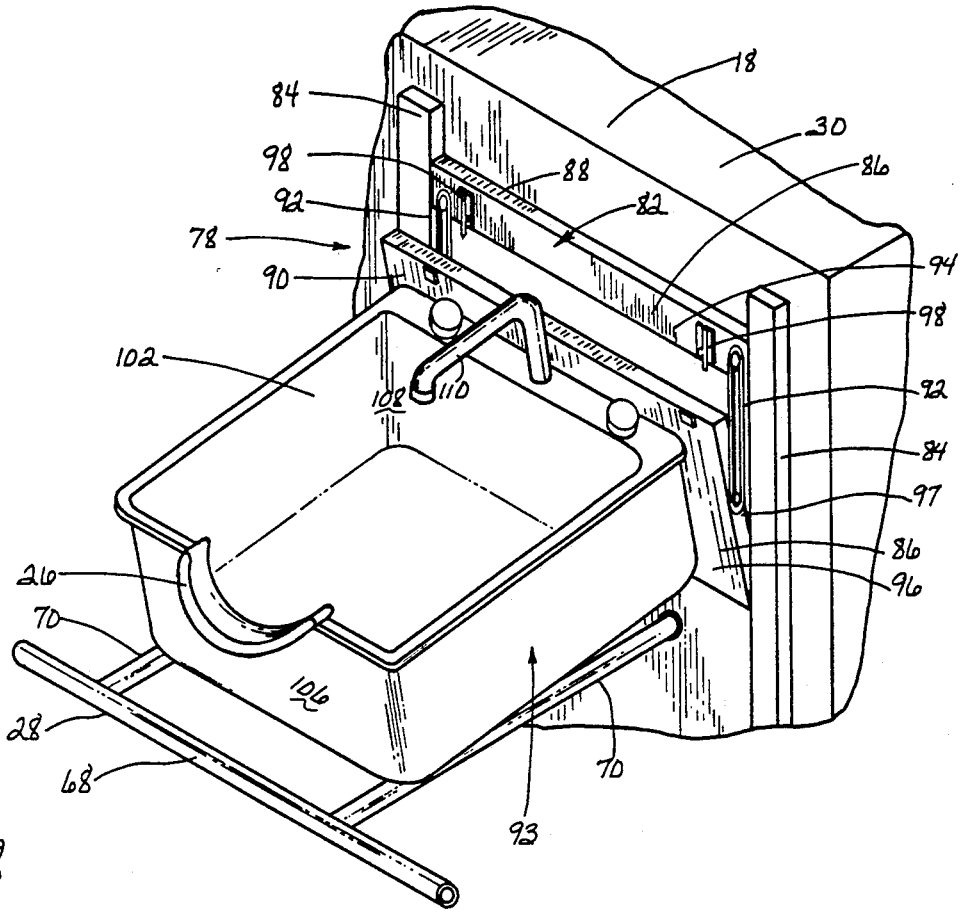
FIG. 8 is a partial perspective view of the head care station of the invention showing the head support and basin in a tilted position.
Figure 9:
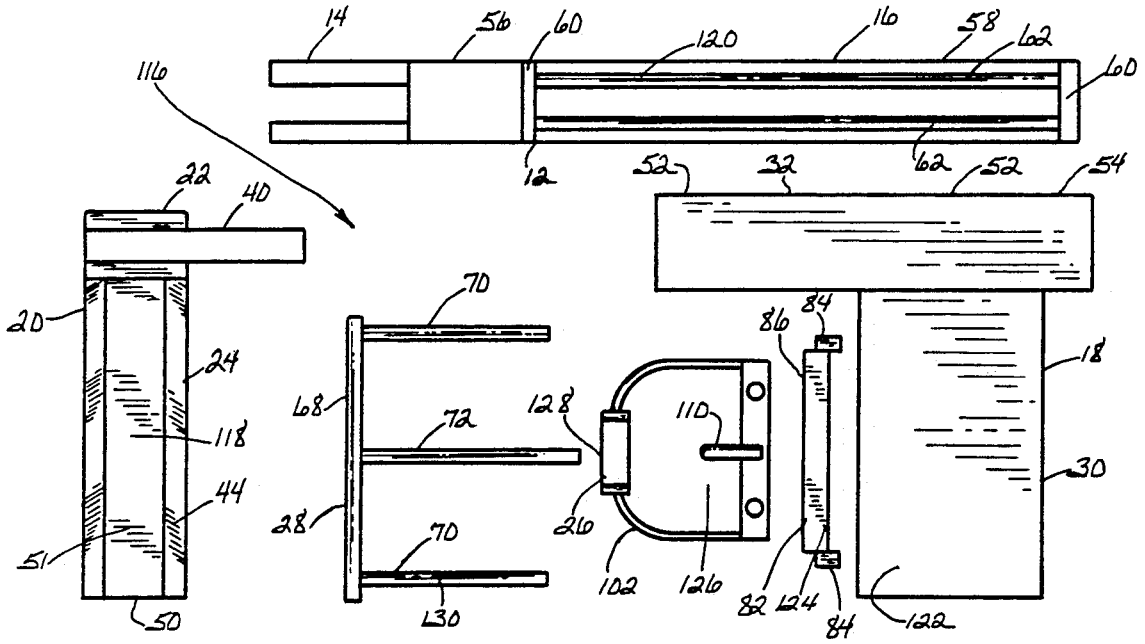
FIG. 9 is a top plan view of the kit of the invention.

Head support 26 is connected to upright member 30 of pedestal 18 and is movable between an upper position 78 and a lower position 80. In a particular embodiment of the invention, a displacer 82 is disposed on working face 76 of upright member 30 of pedestal 18. Displacer 82 includes a pair of parallel track pieces 84 each of which has a slot (not shown) therein. A movable assembly 86 is positioned between track pieces 84. Follower portions 88 of movable assembly 86 has opposite tongue portions (not shown) which ride within the slots in track pieces 84. An attachment portion 90 of movable assembly 86 is connected to follower portion 88 by a pair of links 92. Links 92 are pivotably attached to opposed lateral ends 94 of follower portion 88 and to opposed lateral ends 96 to attachment portion 90 at about the middle 97 of lateral ends 96. Attachment portion 90 is movable between an upright orientation 91 illustrated in FIG. 2, and an inclined orientation 93 illustrated in FIG. 8. Movable assembly 86 may include latches 98 or the equivalent for locking attachment portion 90 in upright orientation 91 against follower portion 88.

Head support 26 is connected in rigid relationship to attachment portion 90. Head support 26 may be in the form of an appliance related to a particular use of the head care station 10 of the invention; for example, a basin or sink 102 as illustrated in the Figures or, alternatively, for example, an instrument tray assembly.

In a particular embodiment of the invention, sink 102, which is rigidly mounted to attachment portion 90, is connected to plumbing 104 and includes head support 26 within an outside wall 106 and a faucet 110 at inside wall 108. Faucet 110 may be varied to meet the needs of a particular use as may plumbing 104, however, provision must be made to accommodate movement of sink 102, such as by the use of flexible plumbing 104. In a particular embodiment of the invention, plumbing 104 includes limiters (not shown) to maintain the temperature of water delivered through faucet 110 within a preselected range.

Head support 26 is movable to any position between and including upper position 78 and lower position 80 and may be retained in position against the weight presented by the head of the occupant of wheelchair 38 tilted against bolster 28 by wheelchair jack 20. A mechanism 112 for moving head support 26 and locking head support 26 in a selected position is illustrated diagrammatically in FIG. 2. Such mechanisms are comparable to the above described mechanisms for moving pedestal 18 and wheelchair jack 20 and are well known to those skilled in the art.

In the embodiment of the invention illustrated in the Figures, the tilting of attachment portion 90 and head support 26 is accomplished manually. In alternative embodiments of the invention, this could be accomplished by powered means comparable to the above described movement mechanisms.

A control 114 may be positioned where useful for the person intended to operate mechanisms 45 and 112. For example, a foot operated control 114 located by upright member 30 to the side of head support 26 opposite from foundation member 12 is useful for an operator who needs hands free to guide the head of a wheelchair occupant against head support 26. Alternatively, control 114 may be positioned on a pedestal (not shown) adjacent front portion 14 so that a wheelchair occupant can actuate control 114. Another alternative control 114 is voice actuated.

The kit 116 of the invention may be assembled into the above-described head care station 10 of the invention. Kit 116, in a particular embodiment of the invention, has a wheelchair jack 118, a foundation member 120, a pedestal 122, a displacer 124, a sink 126 including a head support 128 and a bolster assembly 130.

In operation, an occupied wheelchair 38 is rolled into occupancy space 36. In particular embodiments of the invention, wheelchair 38 is rolled over bearing member 24 of wheelchair jack 20 adjacent foundation member 12 toward bolster 28 and placed into position.

In a particular embodiment of the invention in which the length of occupancy space 36 is fixed, wheelchair 38 of an appropriate length "b" is simply backed into the occupancy space until wheelchair 38 contacts bolster 28.

In embodiments of the head care station 10 of the invention in which wheelchair jack 20 is movable toward a fixed bolster 28, wheelchair 38 is rolled until wheelchair 38 contacts bolster 28, at which time wheelchair jack 20 is moved toward bolster 28. Front wheels of wheelchair 38 are then engaged with bearing member 24 which is in floor position 25. For example, bearing member 24 may be slid under the front wheels of wheelchair 38 or the front wheels may be lifted to accommodate the movement of bearing member 24. When the approximate middle of support surface 51 of bearing member 24 is in contact with the front wheels, movement of wheelchair jack 20 is arrested. Alternatively, wheelchair jack 20 may be relocated relative to bolster 28 prior to placement of wheelchair 38 in occupancy space 36.

In an embodiment of the invention in which bolster 28 is movable toward a fixed wheelchair jack 20, the length "a" of occupancy space 36 may be preset to a selected length. Alternatively, occupancy space 36 may be preset to a maximum length and wheelchair 38 may then be rolled backward until wheelchair 38 contacts bolster 28. Wheelchair 38 may then be moved forward with bolster 28 until front wheels of wheelchair 38 are on support surface 51 by moving bolster 28 toward wheelchair jack 20. Once the front wheels are in the middle of support surface 51, the movement of bolster 28 is arrested.

Once wheelchair 38 is properly located within an appropriately sized occupancy space 36, bearing member 24 of wheelchair jack 20 is then to be raised, tilting wheelchair 38 toward pedestal 18. It is desirable that head support 26, at that time, be in lower position 80. Head support 26 may then be raised against the neck and/or head of wheelchair occupant 39 either vertically or by both vertical motion and the tilting of head support 26. After a head care operation is completed, the process is reversed and wheelchair 38 may be rolled away.

When the personal transport device is a gurney or the equivalent, the operation is the same, except that the wheelchair jack 20 is not actuated.

In addition to the above described process, an emergency exit from the occupancy space is also available to a wheelchair occupant who is capable of lifting the front wheels of the wheelchair and pivoting wheelchair 38 in place. Such an occupant may exit occupancy space 36 while bearing member 24 is in elevated position 27. The availability of this mode of egress allows such a wheelchair occupant to use the head care station 10 of the invention unassisted, without risk of being trapped therein by a power failure or mechanical problem.

While there have been described above the principles of the invention in connection with a specific embodiment, this description is made only by way of example and not as a limitation upon the scope of the claims.

What is claimed is:

1. A head care station comprising a foundation member having a front portion and a back portion, a pedestal mounted on said back portion, a wheelchair jack mounted to said front portion, said wheelchair jack having a bearing member movable between a floor position and an elevated position, a head support connected to said pedestal, said head support being movable between a lower position and an upper position, a bolster connected to said pedestal, said bolster being disposed at a vertical elevation above said elevated position of said wheelchair jack, said wheelchair jack and said bolster defining between them in conjunction with the floor upon which said head care station rests a wheelchair occupancy space.

2. The head care station of claim 1 wherein said occupancy space is free of obstruction.

3. The head care station of claim 1 further comprising means for varying the horizontal separation between said wheelchair jack and said head support.

4. The head care station of claim 1 wherein said bearing member is pivotable from said floor position in a direction of rotation toward said bolster into said elevated position.

5. The head care station of claim 1 wherein said bearing member is longer than said bolster in a direction transverse to said foundation member.

6. The head care station of claim 1 wherein said head support is movable between said lower position and said upper position subsequent to movement of said wheelchair jack.

7. The head care station of claim 1 wherein said occupancy space is offset from said foundation member.

8. The head care station of claim 1 wherein said head support is pivotable between an upright orientation and an inclined orientation, said head support being inclined toward said front portion of said foundation member in said inclined orientation.

9. The head care station of claim 1 further comprising a sink joined to said head support, said sink being movable with said head support, and plumbing for connecting said sink to water supplies and to a sanitary drain line.

10. The head support of claim 1 wherein said bolster is disposed above the center of gravity of said wheelchair and its occupant.

11. The head care station of claim 1 wherein said wheelchair jack further comprises said bearing member and a main portion, said bearing member being cantilevered from said main portion.

12. A head care station comprising a foundation member having a front portion and a back portion, a wheelchair jack having a main portion and a bearing member, said main portion being mounted in fixed relation to said front portion of said foundation member, said bearing member being connected pivotably to said main portion for movement of said bearing member between a floor position and an elevated position, a pedestal engaging said back portion of said foundation member in a linearly displaceable relationship for rectilinear motion of said pedestal along said back portion of said foundation member, a head support upheld in variable vertical displacement by said pedestal, and a bolster connected in rigid relationship to said pedestal, said bolster being disposed horizontally between said wheelchair jack and said head support, said wheelchair jack and said bolster defining between them in conjunction with the floor upon which said head care station rests a wheelchair occupancy space.

13. The head care station of claim 12 further comprising means for pivoting said head support.

14. The head care station of claim 12 further comprising means for pivoting said bearing member, means for moving said pedestal along said foundation member, means for vertically moving said head support, and a control accessible to an operator having both hands engaged in the vicinity of said head support for selectively actuating said means for pivoting and said means for moving along, and said means for moving vertically independently of each other.

15. The head care station of claim 12 wherein said head care station is an independent free-standing unit, requiring only connection to utilities.

16. The head care station of claim 12 wherein said bearing member is substantially planar thereby allowing the rolling of a wheelchair over said bearing member.

17. A head care station kit comprising a foundation member having a front portion and a back portion, a wheelchair jack adapted for mounting to said front portion, said wheelchair jack having a bearing member movable between a floor position and an elevated position, a pedestal adapted for mounting on said back portion, a head support adapted for mounting on said pedestal in spaced vertical and horizontal relation to said wheelchair jack, said head support being movable between a lower position and an upper position, means for reversibly changing the spaced horizontal relationship between said wheelchair jack and said head support after assembly, and a bolster adapted for mounting to said pedestal in fixed horizontal relationship to said head support at a vertical elevation above said elevated position of said wheelchair jack whereby a wheelchair occupancy space is thereby defined by the relative positions of said bolster and said wheelchair jack and the floor upon which said head care station is supported when assembled.

18. A head care station comprising a pedestal having a generally vertical face, said pedestal including a displacer slidably mounted to said working face, said displacer having a follower portion and an attachment portion, said follower portion being mounted in a fixed spatial relationship to said face, said attachment portion being pivotably linked to said follower portion, said head care station further comprising a head support connected in rigid relationship to said attachment portion, and a bolster assembly mounted in fixed relationship to said pedestal, said bolster assembly having a bolster and a plurality of braces, said bolster being disposed in spaced relation and generally parallel to said working face said braces being joined to said bolster and to said pedestal, said braces and said bolster defining a protected space adjoining said working face, said bolster assembly deterring intrusion into said protected space.

19. The head care station of claim 18 further comprising a sink connecting said head support to said attachment portion and plumbing connected to said sink, said plumbing extending, forward of said working face within said protected space.

20. The head care station of claim 19 further comprising a wheelchair jack disposable relative to said working face at a variable spaced relationship.

21. A head care station comprising a bolster and a wheelchair jack disposed in spaced relation to said bolster, said wheelchair jack having a bearing member pivotably movable relative to said bolster between a floor position and an elevated position, said wheelchair jack and said bolster and the floor on which a wheelchair and said bolster and said wheelchair jack are supported, thereby defining a wheelchair occupancy space free of other structure, whereby a wheelchair on said floor in said wheelchair occupancy space is held secure and urged against said bolster while being raised and pivoted about its axle by said wheelchair jack.

22. The head care station of claim 21 further comprising a head support disposed adjacent said bolster.

23. The head care station of claim 22 wherein said head support is movable between a lower position and an upper position independent of pivoting of said wheelchair jack.

24. The head care station of claim 21 further comprising means for varying the horizontal separation between said wheelchair jack and said head support.

25. The head care station of claim 21 wherein said bolster is disposed above the center of gravity of said wheelchair and its occupant.

26. The head care station of claim 21 wherein said occupancy space is free of obstruction 27. The head care station of claim 21 wherein access to said wheelchair occupancy space is unrestricted on one side.

28. A head care station comprising a bolster disposed adjacent a head support and a wheelchair jack having a bearing member movable relative to said bolster between a floor position and an elevated position, said wheelchair jack and said bolster and the floor upon which said wheelchair is supported, thereby defining a wheelchair occupancy space free of other structure, said wheelchair occupancy space being accessible from two adjacent sides without restriction other than said wheelchair jack.

29. A head care station comprising a bolster, a head support disposed adjacent said bolster, said head support being movable vertically and pivotable relative to said bolster, and a wheelchair jack having a bearing member movable relative to said bolster between a floor position and an elevated position, said wheelchair jack and said bolster and the floor upon which said wheelchair is supported, thereby defining a wheelchair occupancy space free of other structure, said wheelchair occupancy space being accessible from two adjacent sides without restriction other than said wheelchair jack.

* * * * *